United States Patent [19]

Saalasti

[11] Patent Number: 4,715,276

[45] Date of Patent: Dec. 29, 1987

[54] MECHANICAL CONTINUOUS DEWATERING PRESS

[76] Inventor: Vaino T. Saalasti, Arinatie 4, SF-00370 Helsinki 37, Finland

[21] Appl. No.: 915,852

[22] Filed: Oct. 6, 1986

Related U.S. Application Data

[63] Continuation of Ser. No. 604,158, Apr. 26, 1984, abandoned.

[51] Int. Cl.[4] ..... B30B 3/06; B30B 9/20

[52] U.S. Cl. ..... 100/121; 100/157; 100/905

[58] Field of Search ..... 100/121, 157, 905

[56] References Cited

U.S. PATENT DOCUMENTS 390,651 10/1888 Crawford ..... 100/157 X
4,355,573 10/1982 Berry ..... 100/121
4,491,067 1/1985 Kipelainen et al. ..... 100/121

FOREIGN PATENT DOCUMENTS 1150283 6/1963 Fed. Rep. of Germany ..... 100/121
3044204 8/1981 Finland ..... 100/121

*Primary Examiner*—Peter Feldman
*Attorney, Agent, or Firm*—Browdy and Neimark

[57] ABSTRACT

The present invention is concerned with a mechanical, continuous dewartering press for a fibrous material, in which press the material to be dewatered is dewatered by compression between a perforated revolving drum and a roll revolving in the said drum so that the high compression force required in the dewatering and the high tangential force resulting from the revolving of the roll are directed by means of levers journalled on the end plates of the frame of the press onto the end plates, on which the counter-blades are also journalled.

5 Claims, 3 Drawing Figures

MECHANICAL CONTINUOUS DEWATERING PRESS

This application is a continuation of application Ser. No. 604,158, filed Apr. 26, 1984, now abandoned.

The invention relates to dewatering of fibrous material at high compression pressure. As an example is stated the dewatering of wet bark of a tree for fuel. The invention is in particular concerned with a continuously operating pressing wherein the fibrous material is dewatered by compression between a perforated revolving drum and a roll revolving in the drum.

In practice it has been ascertained that continuous drum presses are reliable in operation and, consequently, advantageous. Even though the dewatering drum in accordance with the Finnish Pat. No. 62,330 has been noticed to be good and efficient, it is, however, too large for little industrial plants. The dewatering press in accordance with the Finnish Patent Application No. 82,1858 is more suitable for smaller industrial plants. It can be constructed so that it has a small size but, nevertheless, a good dewatering output.

In order that a continuous machine should operate without disturbance, it must have a minimum of wearing parts. Thus, the present invention is concerned with the elimination of the wear caused by the movement in the compression direction of the bearing housing of the roll in a machine in accordance with the FI Patent Application No. 82,1858. In the said dewatering press, the bearings of the roll are guided in openings in the frame, wherein the pressure cylinders push the bearing housings, and thereby the roll, against the drum. Thus, the bearing housing must move constantly as guided by the frame, while a high lateral force is, at the same time, acting upon it. The object of the present invention is to eliminate this wearing movement by means of an improved solution for the compression of the roll.

The dewatering press in accordance with the invention, which is provided with a perforated revolving drum 1 and with a press roll 2 revolving in the drum and in which the drum revolves between a counter-roll 3 and the material layer to be dewatered as well as the compressing press roll 2, is characterized in the features stated in the characterizing part of claim 1.

The invention will be described in more detail with the aid of the attached drawings. The drawings illustrate a bark dewatering press in accordance with the invention, whose construction may, however, be modified within the scope of the patent claims.

Figure 1:
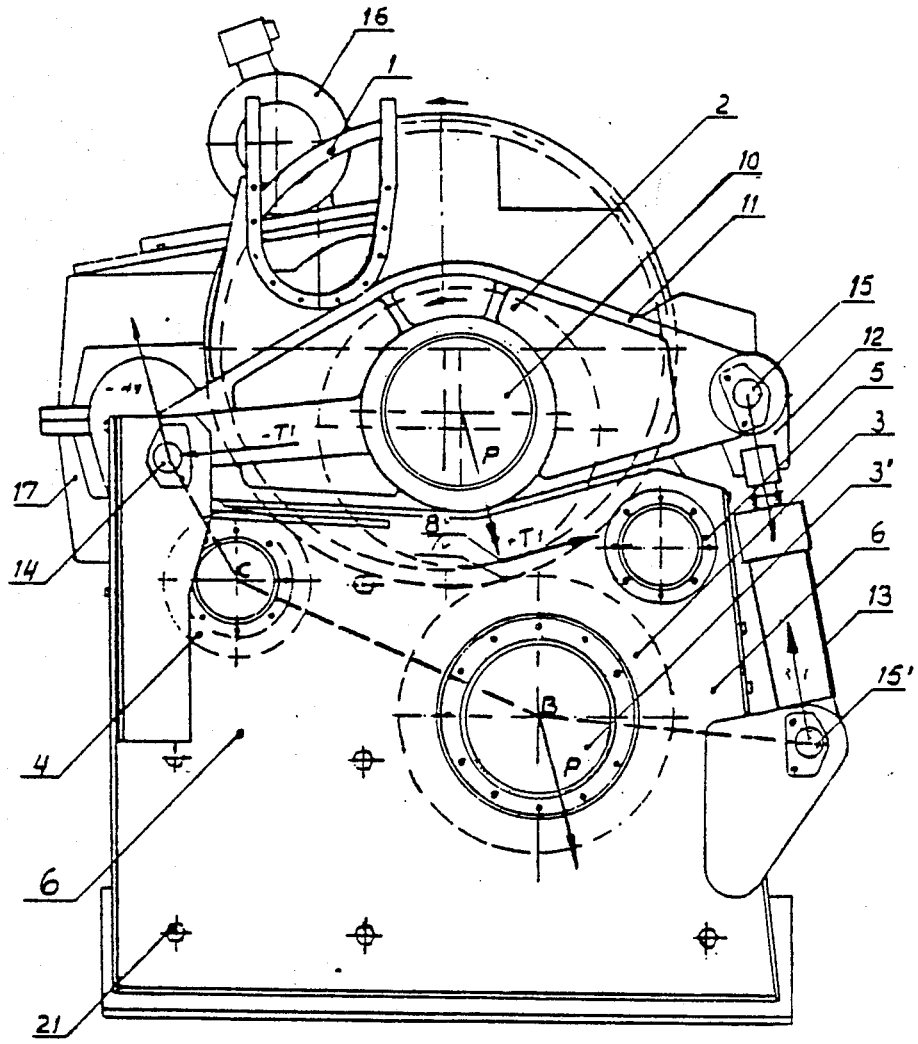
FIG. 1 shows the device as viewed from the upper end, i.e. from the end through which the wet bark is introduced into the machine.

The figures illustrate a dewatering press which is intended in particular for the dewatering of the bark of a tree. FIG. 1 shows the perforated drum 1, in which there is the press roll 2. The drum is placed so that it revolves as supported on a counter-roll 3 and two auxiliary rolls 4 and 5, all of which are journalled on the end plates 6 of the bark press. The counter-roll 3, which receives the compression force proper, is journalled as revolving so that it is in contact with the drum at the compression point 7. The contact point 8 between the press roll 2 and the drum 1 may be somewhat before the compression point 7, relative the direction of rotation, whereby the balancing of the machine becomes more advantageous in practice.

The auxiliary roll 4 is journalled on the end plates so that, in the direction of rotation, it is placed somewhat before the counter-roll 3 and a little higher than the location of the counter-roll. Moreover, a second auxiliary roll 5 is journalled on the end plates, being loaded only if some hard object is included among the bark, which, when passing through the compression point 8, may cause a power component inclining the drum 1 towards the auxiliary roll 5. In normal working, when there is bark between the drum 1 and the roll 2, the roll 2 presses the bark and the drum 1 against the counter-roll 3 and the auxiliary roll 4 so that most of the force acts upon the counter-roll 3. The auxiliary rolls are therefore of smaller diameter and of less heavy construction as compared with the counter-roll 3.

The construction of the rolls 3, 4 and 5 and of the drum 1 is such that they remain in the correct axial position. The construction of the drum 1 may be, e.g., such that its ends are provided with reinforcement rings which guide the drum so that it remains in the correct position on the rolls. The construction may also be similar to that shown in FIG. 3, so that there are elevation rings 4' and 5' at the ends of the rolls 4 and 5.

Figure 2:
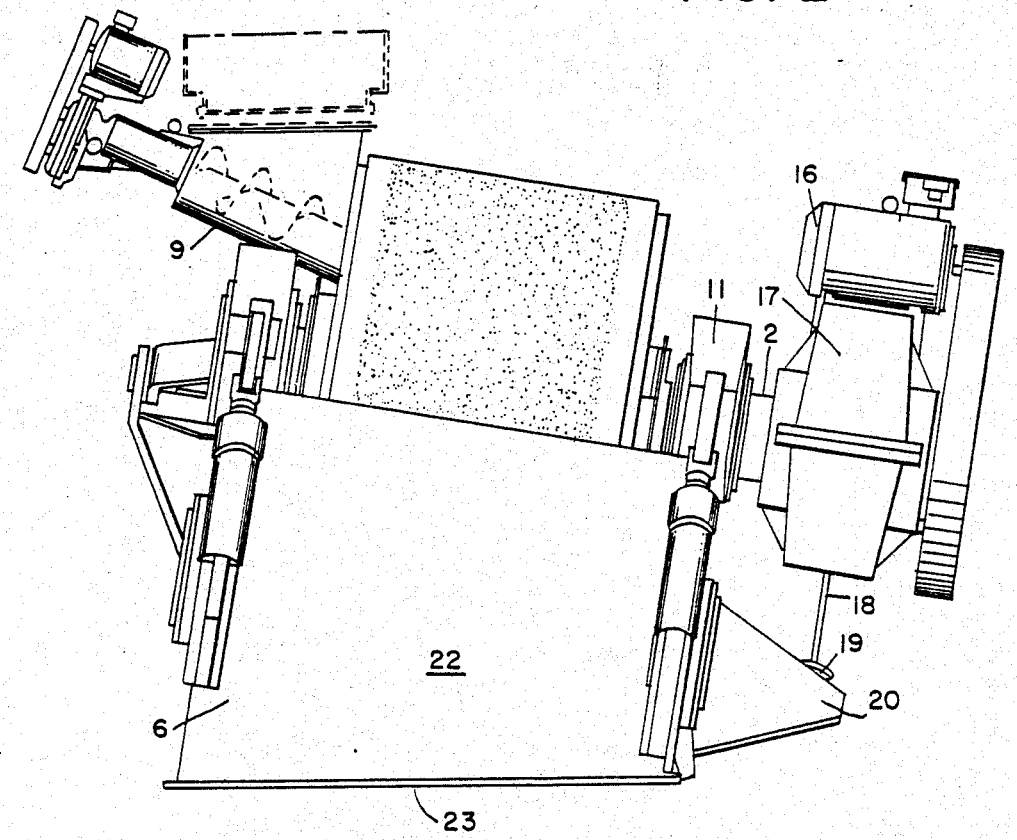
FIG. 2 is a side view of the device.
Figure 3:
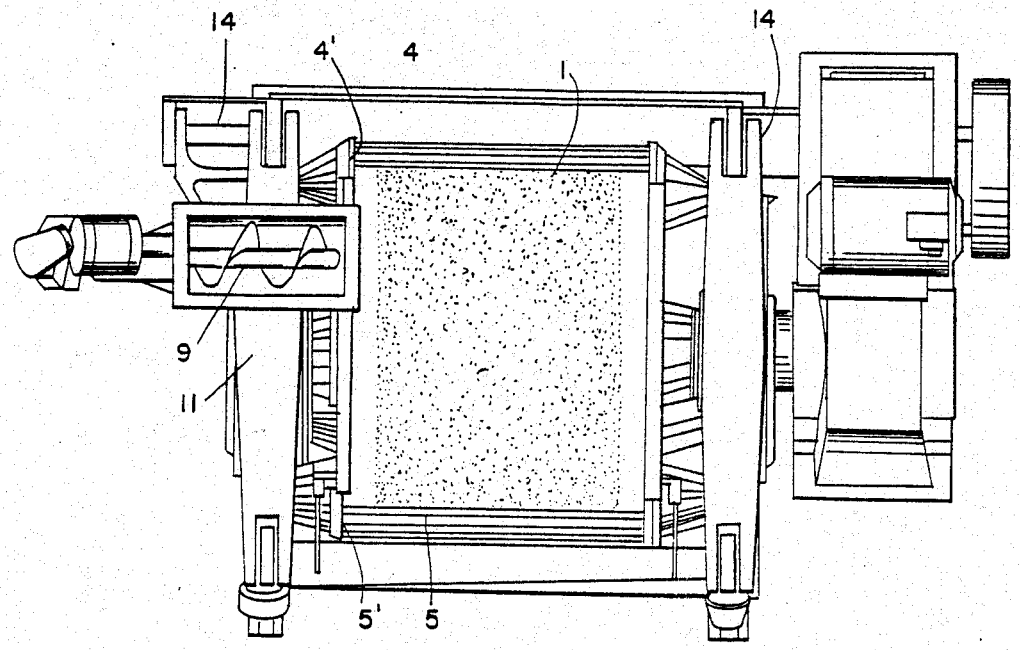
FIG. 3 is a top view of the device.

FIGS. 2 and 3 show the bark feeder screw 9 rotated by a motor, by means of which the wet bark is fed into the drum, where it is compressed between the press roll and the drum. Inside the drum, there are guide wings and scrapers which are helpful in making sure that the bark is compressed, e.g., 4 to 5 times before it falls out of the drum.

On the outside face of the drum, there is a scraper or scrapers, which remove any fibres passing through, and hanging from, the holes before they are compressed between the counter-roll 3 and the drum 1, in which case the holes might be blocked.

As is seen from FIG. 1, the direction of compression of the press roll 2 is somewhat inclined from the vertical direction. Small axial projections on the face of the roll are helpful in carrying the bark into compression between the roll and the drum.

In the construction in accordance with the invention, the drum is supported over its entire width against the counter-roll 3, so that the drum stands high pressures without being subject to bending strains.

The number of compressions of the bark depends on the inclination of the drum of the machine and/or on the guiding by the guide wings in the drum, i.e. on the distance that the bark travels inside the drum during each revolution. It is possible to construct the frame of the machine such that the inclination of the drum can be adjusted, whereby the inclination can be adjusted on the basis of the moisture content of the bark. Likewise, the guide wings may be adjustable.

The compression of the press roll 2 against the bark fed into the drum is produced so that the roll 2, FIG. 1, is journalled at its ends in bearing housings 10 provided in compression levers. One end of the compression levers 11 is journalled to the frame by means of a pin 14, which is, in this construction, before the compression point 8 in the direction of rotation of the drum. The opposite end of the compression levers 11 is journalled to the piston rod 12 of the pressure cylinder 13 by means of a pin 15. The piston rods 12 of the pressure cylinders pull the end of the compression levers 11 downwards at a power of about 60 tons. Thus, the roll 2 presses the bark layer at a power of about 250 tons against the perforated drum 1, whereby the water contained in the bark escapes down through the holes in the drum.

For the sake of clarity, the forces acting upon the end plate 6 during operation of the press are illustrated in FIG. 1. Let us assume, for example, that the tractive force +HV of the hydraulic cylinder, pulling the end of the compression lever 11 downwards, is about 60 tons. The same force of 60 tons acts at the lower end of the cylinder, pulling the frame plate 6 upwards at point A. The compression lever 11 is journalled on the frame by means of the pin 14. The pin is acted upon by the hydraulic tractive force −HV, i.e. in the opposite direction, and additionally by the tangential force −T1 of the press roll 2. The shaft of the press roll is journalled at the middle of the compression lever by means of the bearing 10. The compression lever presses this shaft end of the roll down at a power P of about 120 tons, and the shaft end of the counter-roll 3 presses the end plate 6, by the intermediate of the bearing 3', at point B downwards at an equal power P' of about 120 tons.

At point D, the compression lever presses the end plate 6 to the left in the figure at the force −T1, which force is almost equal to the tractive force of the cylinder.

From this description it is noticed that all of the high forces act at the compression lever 11, at the thick end plate 6 and at the hydraulic cylinder, as well as in the link pins 14, 15 and 15' connecting them.

By means of the construction in accordance with the invention, it has been possible to avoid gliding and wearing constructions, and no forces act upon the frame of the machine, but the thick (about 100 mm) end plates absorb all the forces by the intermediate of non-wearing bearings and articulated joints.

Since, with the construction in accordance with the invention, no high strains caused by the compression forces act upon the frame of the dewatering machine, the frame can be constructed as a low-weight box construction. Likewise, for the assembly of the machine, one of the end plates may be made readily detachable, e.g., by means of a bolt joint, bolts 21 in FIG. 1.

FIG. 2 shows the positioning of the motor 16 rotating the roll 2 and of the gearbox 17 on the shaft 2' of the roll 12 at the end of the machine through which the compressed bark comes out.

This gearbox 17 is a so-called pivot gearbox, whose free end is supported by means of a torque support 18 and an elastic coupling 19 on a projection 20 of the frame of the machine. Underneath the frame, a flow-out space 22 and a flow-out opening 23 are provided for the water drained out of the bark.

Even though, as an example, a bark press intended for the dewatering of bark has been described, the press in accordance with the invention may also be applied to the dewatering of other fibrous materials, such as waste paper, fibre pulps, fish-cleaning waste, twigs and roots separated from peat, etc. The construction of the dewatering press may be varied within the scope of the patent claims depending on the purpose of use.

What is claimed is:

1. A dewatering press for expressing water from wet bark including a perforated, revovling drum disposed in an inclined operating position and through which material to be dewatered runs from an upper end to a lower end, more than one support roll for supporting said drum in said operating position, and a press roll in pressing contact with, and revolving inside, the drum, the material to be dewatered being compressed between the drum and the press roll several times, characterized in that: said drum revolves between a drum pressing counter roll and said press roll, and said press roll and said counter roll are disposed opposite one another, and during compression of said material to be dewatered, said press roll presses said drum against said counter roll and said more than one support roll, the counter roll countering the force of the press roll and the drum when the press roll is moved into compression with the bark pressed against the inside of the drum, so that most of the force acts upon the counter roll, thus reducing the force which would otherwise be applied to said support rollers, such that balancing of the machine may be achieved during compression of the wet bark, said support rolls and said counter roll being mounted between two end plates, at least one of said plates being easily removeable, said support rolls being of smaller diameter than the counter roll and being disposed on opposite sides of said counter roll and a little higher than the location of the counter roll.

2. The dewatering press of claim 1, and further characterized in that said press includes planar end plates, hydraulic cylinder means, and a compression lever for (1) producing a high compression force required for compressing the material to be dewatered to a dry state as well as (2) directing the high forces resulting from the rotational torque of the press roll, one end of said compression lever and said hydraulic cylinder means being mounted in one end plate, said counter roll being journalled in said end plates, and said hydraulic cylinder being coupled to, and moving, the other end of said compression lever into and out of a material compressing position.

3. The dewatering press of claim 2, and further characterized in that at least one support roll is mounted between the end plates for supporting said revolving drum.

4. The dewatering press of claim 2, characterized in that all the high forces required for compressing the material to be dewatered act upon the compression lever, the end plates and the hydraulic cylinder.

5. The dewatering press of claim 2, and further characterized in that a drive motor and a gear box are provided for driving the press roll in rotation, said press roll including a shaft journalled in said compression lever and extending through said compression lever to support said gear box, said motor being placed on said gear box.

* * * * *